US005738120A

United States Patent [19]

Chard

[11] Patent Number: 5,738,120

[45] Date of Patent: Apr. 14, 1998

[54] SMOKING ARTICLES

[75] Inventor: Brian Chester Chard, Saltford, Great Britain

[73] Assignee: Imperial Tobacco Limited, Bristol, Great Britain

[21] Appl. No.: 628,618

[22] PCT Filed: Oct. 21, 1994

[86] PCT No.: PCT/GB94/02339

§ 371 Date: Jun. 6, 1996

§ 102(e) Date: Jun. 6, 1996

[87] PCT Pub. No.: WO95/10952

PCT Pub. Date: Apr. 27, 1995

[30] Foreign Application Priority Data

Oct. 23, 1993 [GB] United Kingdom ..... 9321911
Jun. 17, 1994 [GB] United Kingdom ..... 9412195

[51] Int. Cl.[6] ..... A24D 3/06

[52] U.S. Cl. ..... 131/335; 131/336; 131/337; 131/341; 131/198.1; 131/198.2

[58] Field of Search ..... 131/331, 332, 131/335–337, 338, 339, 340, 198.1, 198.2, 349

[56] References Cited

U.S. PATENT DOCUMENTS 4,898,190 2/1990 Deal ..... 131/198.2 X
4,904,308 2/1990 Charlton et al. ..... 131/198.2
5,331,981 7/1994 Tamaoki et al. ..... 131/337

*Primary Examiner*—Vincent Millin
*Attorney, Agent, or Firm*—Larson & Taylor

[57] ABSTRACT

A smoking article comprising a smoking rod, a filter and ventilation means incorporated in the filter and communicating with the outside of the smoking article, viscous fluid in the ventilation means closing or partially closing the ventilation means, the viscous fluid being displaceable during use of the smoking article enabling ventilation to occur.

35 Claims, 5 Drawing Sheets

SMOKING ARTICLES

Figure 1:
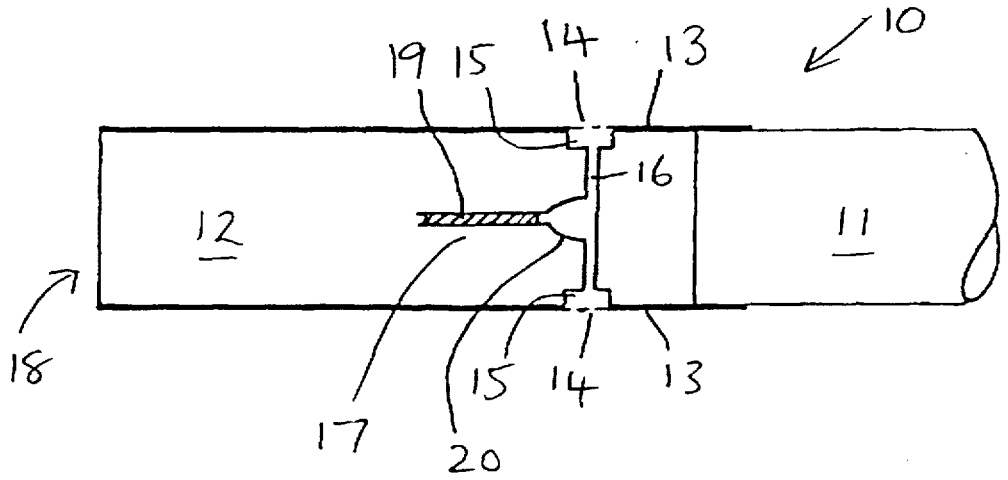

This invention relates to smoking articles and particularly but not exclusively to filter cigarettes.

Smokers of cigarettes have varying tastes and preferences. Within the population of smokers there are various groups such as those who prefer low tar and those who prefer higher tar. They all choose their particular brands and smoke them as they wish. There are, however, extreme cases such as those who buy one brand of filter cigarette but prior to smoking detach the filter. Others smoke low tar cigarettes but in an unusual fashion in that the filter is placed well into the mouth thereby blocking the vents with the lips. Others prefer middle tar cigarettes and may only smoke the first half.

Cigarettes ate commonly ranked according to their tar delivery which is evaluated by machine smoking at predetermined puff volume, duration of puff and interval between puffs. Smokers, however, perform their habit as they please and a cigarette that does not readily conform to their smoking pattern is deemed poor whilst a cigarette that conforms to their wishes is satisfying.

According to the present invention there is provided a smoking article comprising a smokable rod and ventilation means whereby, in use, the puffing characteristics of the smoker determine the amount of ventilation given by the ventilation means, the ventilation means being initially closed or partially closed by a viscous fluid.

It will be appreciated that the term 'viscous fluid' not only includes liquids but also materials that are "plastic" in that they are deformable or displaceable by means of a pressure differential without returning to their original shape after the pressure differential is removed. The term, therefore, includes gels, petroleum jellies, grease etc.

The ventilation means may be incorporated into a filter. The filter may have conventional ventilization besides the ventilation means described. The ventilation means when acted upon during puffing reacts and continues to react during subsequent puffs in a manner dependent upon the puffing characteristics employed until it intervenes enabling an increase in ventilation.

The ventilation means preferably continues to react to the puffing whereby the ventilation continues to increase towards a maximum. The smoking article has an inherent lower delivery not manifest at the start of smoking. This manifestation is realised once the smoker has exerted sufficient demands upon the smoking article and his want is somewhat satiated.

Commonly the ventilation means will include a system of vents in the periphery of the filter.

In one arrangement the viscous fluid disposed in one or more tubes, said one or more vents communicating only with said one or more tubes. Conveniently said one or more tubes have ends of wider bore towards the air entry end to prevent capillary loss of the viscous fluid.

In another arrangement the viscous fluid is disposed in one or more channels located in the periphery of the ventilation means, said one or more vents communicating only with said one or more channels.

The tubes or channels may have varying cross-sections along their longitudinal axis.

Means may be provided around the fluid exit end of the channels or tubes to assist the removal of viscous fluid. This removal means may comprise an absorbent material, tube, or tubes, slit or slits to wick away the fluid. The tubes may be concentric, in line or at an angle to the fluid tube.

The removal means is so positioned such that capillary loss by surface tension does not operate until the viscous fluid has been expressed by the action of puffing.

In a further arrangement the viscous liquid is disposed in an open ended tube which has a smaller internal cross sectional area towards the air entry end. Preferably the tube is conical.

Preferably the viscous fluid in the channels or tubes has a viscosity of between 0.01 Poise and 1000 Poise (0.01 Stokes and 1000 Stokes). One suitable fluid is glycerol and others includes syrups like sugar in water as well as vegetable and mineral oils. The channels or tubes may also contain particles and/or fibres.

With the above described smoking articles the ventilation is low or zero at the start of smoking whereby the articles readily conform to the demands of smokers whilst, dependent upon the smoker's puffing characteristics, later the articles ventilate thereby allowing the smokers to continue puffing as previously without exceeding their need. Furthermore, compared to conventional smoking articles, the range of total tar deliveries, obtainable with puff volume, is much smaller thereby limiting the total tar a smoker may obtain; the deliveries per puff are more uniform and the pressure drop decreases over the smoking period.

Conventional cigarettes, when machine smoked, generally give an increasing yield of tar with puffing, for example:

For a smoking regime of 2 second puff duration and a frequency of one puff per minute with the given puff volumes the following data was obtained:

| Puff | TPM (mg) deliveries at given Puff Volumes | | |
|---|---|---|---|
| Number | 25 ml | 35 ml | 50 ml |
| 1 | 0.51 | 1.04 | 1.27 |
| 2 | 0.47 | 0.93 | 1.23 |
| 3 | 0.50 | 1.08 | 1.50 |
| 4 | 0.60 | 1.07 | 1.58 |
| 5 | 0.66 | 1.13 | 1.63 |
| 6 | 0.77 | 1.28 | 1.75 |
| 7 | 0.89 | 1.31 | 1.99 |
| 8 | 0.94 | 1.60 | 2.10 |
| 9 | 0.96 | 1.59 | 2.83 |
| 10 | 1.00 | 2.01 | |
| Total Tar | 7.30 | 13.04 | 15.88 |

The ventilation (%) and Pressure Drop data with Puff Number is given below:
(where Pressure Drop (PD) mm H20 is the maximum over the puff)

| | Puff Volume | | | | | |
|---|---|---|---|---|---|---|
| | 25 ml | | 35 ml | | 50 ml | |
| Puff No. | Vent % | PD mm | Vent % | PD mm | Vent % | PD mm |
| 1 | 24.1 | 160 | 34.0 | 177 | 32.0 | 257 |
| 2 | 24.3 | 154 | 35.0 | 180 | 31.0 | 261 |
| 3 | 23.5 | 164 | 33.5 | 179 | 32.5 | 261 |
| 4 | 22.5 | 162 | 32.4 | 175 | 28.8 | 259 |
| 5 | 25.4 | 160 | 30.0 | 173 | 30.0 | 261 |
| 6 | 25.5 | 153 | 31.0 | 173 | 30.8 | 257 |
| 7 | 22.0 | 151 | 29.9 | 169 | 28.8 | 264 |
| 8 | 22.2 | 153 | 29.8 | 175 | 32.8 | 272 |
| 9 | 21.1 | 152 | 31.7 | 178 | 30.8 | 266 |
| 10 | 22.2 | 157 | 28.9 | 176 | | |

The tar yield profile results in the strength of the cigarette increasing considerably during smoking. Obviously, if the initial strength is acceptable to the smoker then it will become stronger and less acceptable during smoking and the converse will also be true i.e. if the final strength is acceptable then the cigarette is initially too mild.

The present invention reduces or eliminates the yield profile so that if the initial delivery is acceptable then it will remain so throughout the smoking of the cigarette.

Our arrangements also allow a smoker to conform the cigarette, by the action of puffing, to their needs without the problem of too much diluting air. Once their early desire is satiated their want often declines and so, depending on their early demands, sooner or later the ventilation increases thereby allowing a consistent delivery as to need.

Alternatively the smoker can puff on an unlit cigarette so as to open the ventilation prior to lighting up.

Smoking articles and particularly cigarettes have an inherent lit resistance. The energy utilised in puffing to obtain sufficient smoke is essentially the product of the volume and pressure drop created. The pressure drop created is the product of the flow rate and lit resistance. High resistance, 'high pressure drop' cigarettes require more energy by the smoker to achieve the same puff volume. Our arrangements allow the energy used in puffing to be partitioned between the generation of smoke and work done on the ventilation means. This partition is very much in favour of smoke generation. Air is allowed through once sufficient partitioned energy has been used to open the ventilation means. The energy required is dependent upon the dimensions of the ventilation means, the fluid used and the puffing characteristics of the smoker.

The preferred ventilation means consists of air vents, a fluid blocked tube and a receiving system to remove the fluid expressed over successive puffs. The chosen smoking article e.g. a cigarette would require a minimum ventilation at the outset of puffing and a maximum ventilation after sufficient puffs to express the fluid from the tube. The minimum ventilation can be supplied using conventional means. A simple resistance model may be used to estimate the required resistance to air flow of the empty fluid tube. Once the resistance to air flow of the empty fluid tube is known the dimensions of the tube may be estimated from the Poiseuille equation. These dimensions are not unique but the length of tube and radius of the bore are related. The tube bore and length need to comply with the requirements necessary to hold the fluid by surface tension. These requirements must fulfil the condition that the fluid is not expressed prior to smoking i.e. the fluid must not empty under gravitational pull or expression due to rates of change of momentum.

The fluid fill is chosen with regard to its viscosity given the possible tube dimensions consistent with the maximum ventilation and surface tension requirements. A first estimate as to the required viscosity may be obtained from the Poiseuille equation where consideration is given to the fact that the tube is emptying. In practice the fluid viscosity is changed if the estimated viscosity does not achieve the required operating characteristics as to ventilation. The fluid must not empty too quickly or too slowly under a given series of puffs (the pressure drop being dependent on the lit resistance). For each puff the fluid expressed needs to come under the influence of the removal means such that at least some of the fluid expressed is removed. After sufficient puffs the tube opens allowing some ventilation through the means and over further puffs the ventilation increases towards the maximum.

Figure 8:
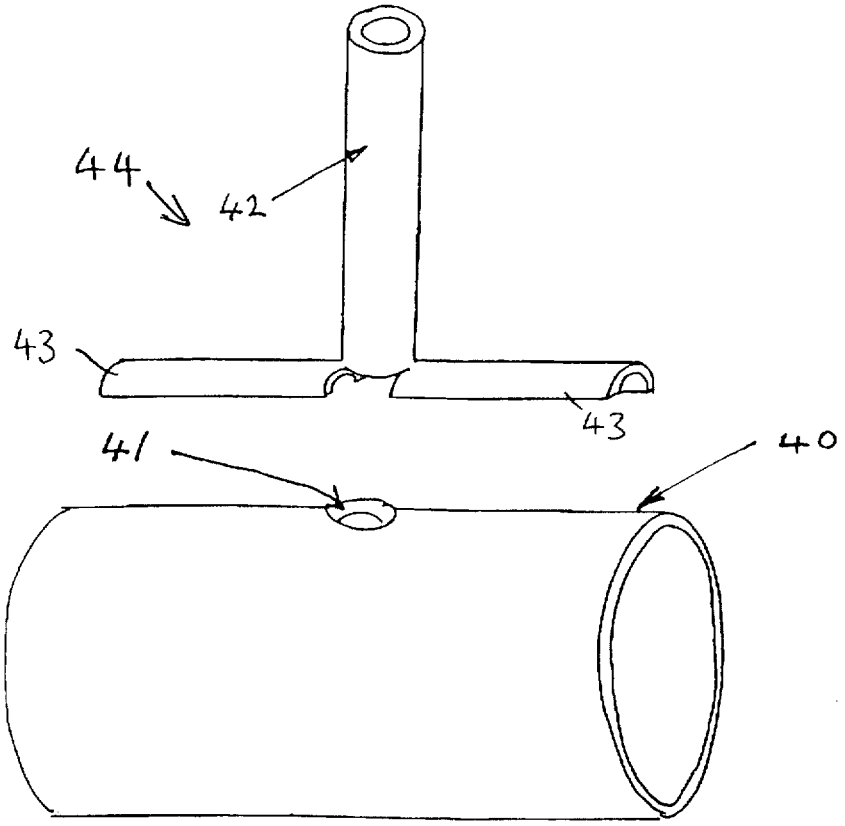
Figure 9:
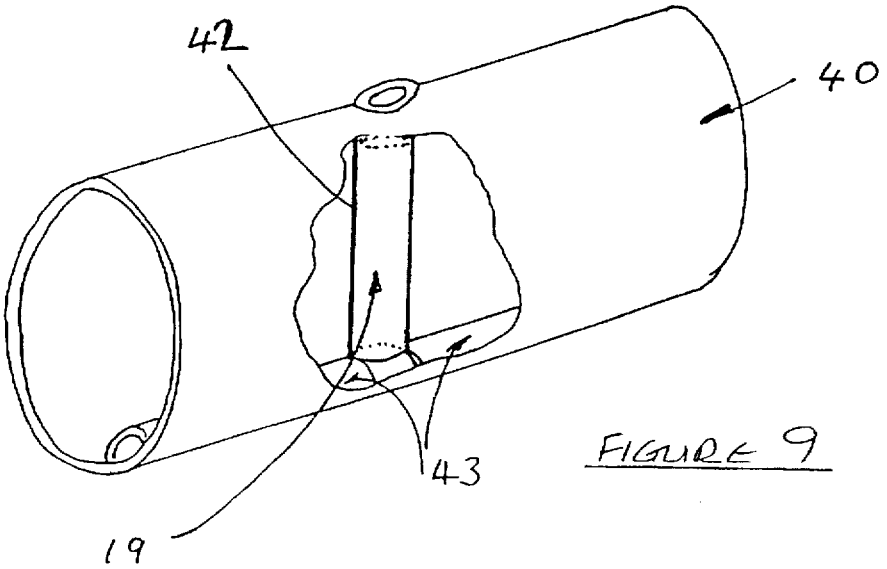

An example according to the present invention is given in FIGS. 8 and 9 which show the construction and dimensions of the ventilation means. In this example the tube containing the fluid of viscosity 125 Poise (125 Stokes) and the collection tubes were fashioned from a single piece of polyethylene tube. The ventilation means was attached to a conventional filter cigarette. The tar yields with puffing are given below.

For a smoking regime of 2 second puff duration and frequency one puff per minute with the given puff volumes, the following data was obtained:

| Puff | TPM (mg) deliveries at given Puff Volumes | | |
|---|---|---|---|
| Number | 25 ml | 35 ml | 50 ml |
| 1 | 0.64 | 1.06 | 1.11 |
| 2 | 0.66 | 0.92 | 1.06 |
| 3 | 0.79 | 0.81 | 1.06 |
| 4 | 0.96 | 0.75 | 0.96 |
| 5 | 0.99 | 0.79 | 0.95 |
| 6 | 1.01 | 0.77 | 1.08 |
| 7 | 1.05 | 0.82 | 1.01 |
| 8 | 0.96 | 0.80 | 1.09 |
| 9 | 1.02 | 0.81 | 1.07 |
| 10 | 0.98 | 0.82 | 1.07 |
| Total Tar | 9.06 | 8.35 | 10.46 |

The ventilation (%) and Pressure Drop data with Puff Number is given below:
(where Pressure Drop (PD) mm H20 is the maximum over the puff)

| | Puff Volume | | | | | |
|---|---|---|---|---|---|---|
| | 25 ml | | 35 ml | | 50 ml | |
| Puff No. | Vent % | PD mm | Vent % | PD mm | Vent % | PD mm |
| 1 | 0 | 147 | 0 | 221 | 7.0 | 318 |
| 2 | 0 | 158 | 0 | 207 | 25.0 | 233 |
| 3 | 0 | 157 | 14.7 | 161 | 28.4 | 236 |
| 4 | 0 | 159 | 22.6 | 133 | 30.0 | 181 |
| 5 | 0 | 154 | 29.2 | 137 | 33.3 | 174 |
| 6 | 0 | 146 | 33.9 | 115 | 37.5 | 160 |
| 7 | 0 | 143 | 36.8 | 115 | 46.2 | 176 |
| 8 | 21.0 | 145 | 36.2 | 116 | 38.2 | 161 |
| 9 | 31.2 | 142 | 40.8 | 111 | 39.8 | 153 |
| 10 | 38.4 | 145 | 42.2 | 123 | 45.8 | 151 |

Figure 2:
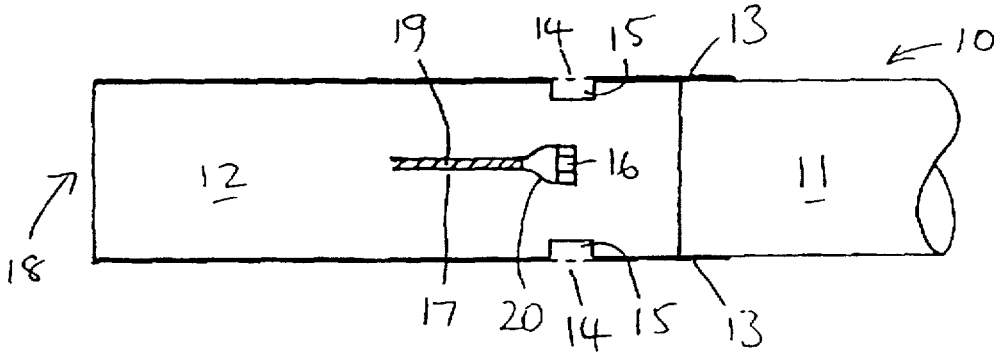
Figure 3:
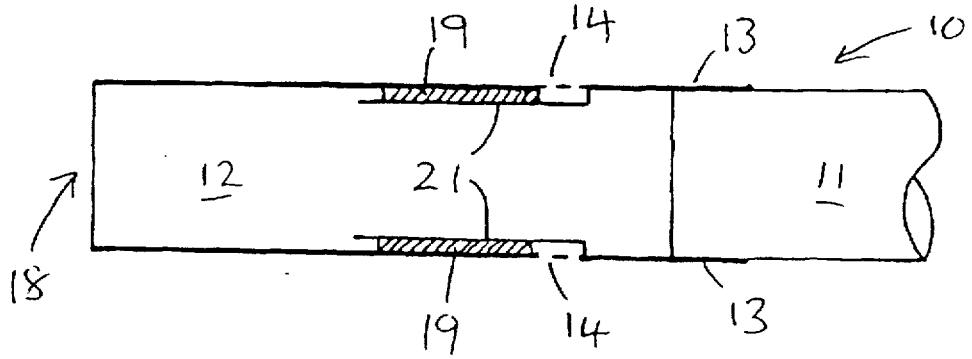
Figure 4:
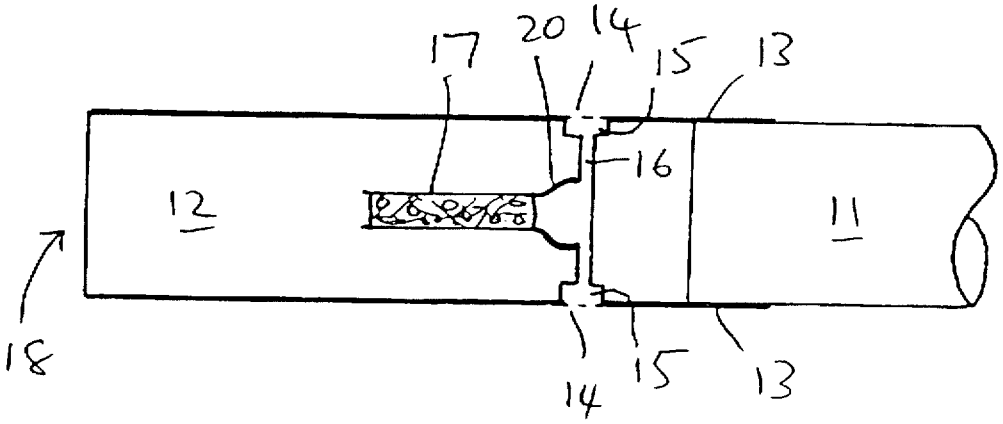
Figure 5:
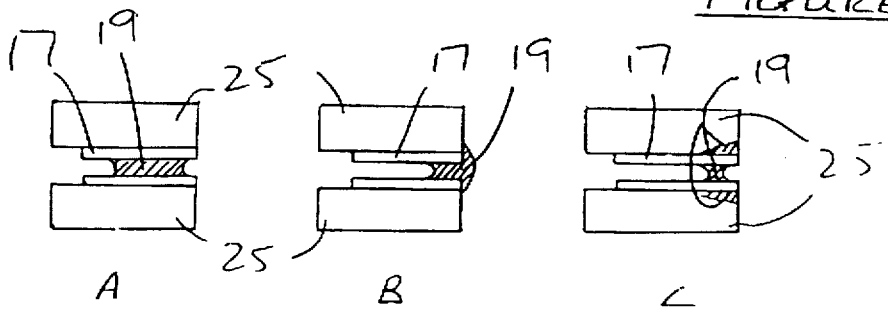
Figure 6:
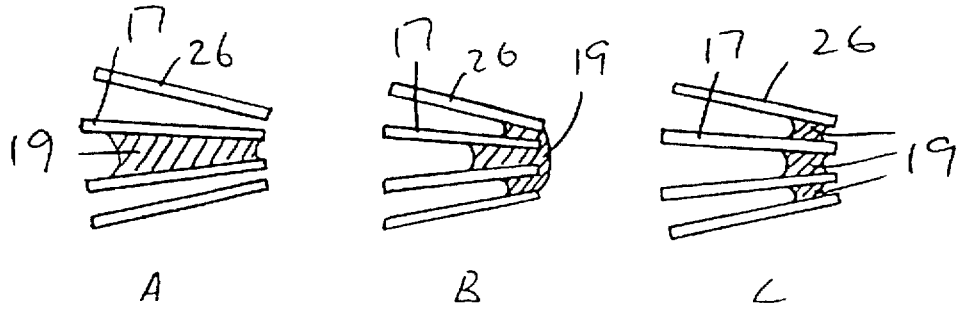
Figure 10:
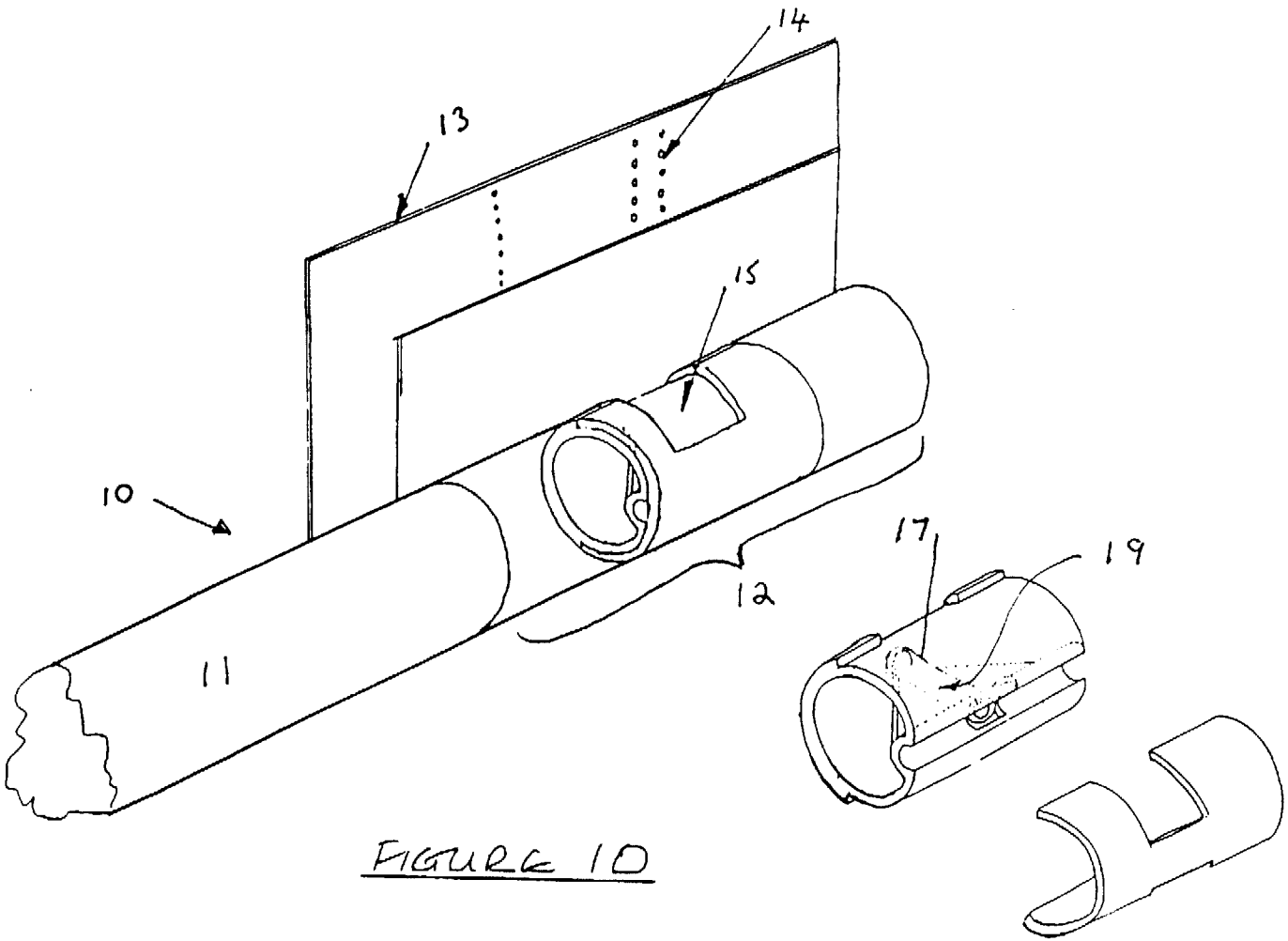

Embodiments of the present invention will now be described in more detail. The description makes reference to the accompanying diagrammatic drawings in which:

FIG. 1 is a lengthwise cross-section through a cigarette according to the present invention, FIG. 2 is a lengthwise cross-section at 90° to the section in FIG. 1, FIG. 3 is a lengthwise section through a second embodiment of smoking article according to the present invention, FIG. 4 is a lengthwise section through a third embodiment of smoking article according to the present invention, FIGS. 5A, 5B and 5C are lengthwise sections through a further embodiment of tube for use in a smoking article according to the present invention, FIGS. 6A, 6B and 6C are lengthwise sections through a still further embodiment of tube, FIGS. 7A, B, C and D are lengthwise sections through another embodiment of tube, FIG. 8 shows a perspective view of the components of a still further embodiment, FIG. 9 shows a cut away perspective view of the FIG. 8 components in assembled form, and FIG. 10 shows a part assembled perspective view and an exploded view of a yet further embodiment.

In FIGS. 1 and 2 there is shown a smoking article 10 comprising a smokable tobacco rod 11, or other flavour delivery systems attached to a filter 12 by means of conventional tipping paper 13. The filter 12 and the paper 13 incorporate ventilation means in the form of perforations 14 in the paper 13 communicating only with a circumferential groove 15 in the filter 12 which groove incorporates a diametrical through passage 16 which in turn communicates with a tube 17. The tube 17 extends lengthways of the filter 12 towards the mouth end 18 of the smoking article 10 and contains a quantity of viscous fluid 19. The tube 17 has end 20 of enlarged bore so as to prevent loss of the viscous fluid 19 by capillary action, the surface tension of the fluid 19 keeping it in the tube. Clearly, the larger the bore the shorter the length of fluid that can be held by the surface tension. Also, as fluid is expressed, the viscous resistance of the remainder is reduced as there is less fluid present. These considerations have to be taken into account during design.

The fluid 19 effectively blocks air from being drawn through the perforations 14, through the passage 16, down the tube 17 towards the mouth of the smoker. The viscous fluid 19 is confined such that when a smoker puffs the cigarette the fluid is expressed to a greater or lesser degree depending on the strength of draw by the smoker. Once sufficient draws have been taken such that viscous fluid has been expressed, an air way is formed and ventilation takes place. Full ventilation takes place once the maximum amount of viscous fluid has been expressed. In practise there will probably still be a coating of fluid in the tube 17.

One preferred viscous fluid 19 is glycerol which has a viscosity of around 10 Poise. Air's viscosity is about $1.8\times 10^{-4}$ Poise. It is envisaged that any viscous fluids could be used, although preferably in the range 0.01 Poise to 1000 Poise.

By way of example, a cigarette constructed similarly to the FIG. 1 and 2 arrangement of 0.004 $cm^3$ capacity and length 1.9 cm filled with glycerol was observed on machine smoking to have the following dilution:

| Puff No | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| Dilution % | 0 | 0 | 3 | 8 | 11 | 12 | 15 | 16 | 18 | 19 | 21 | 23 | 22 | 22 | 22 |

It will be appreciated that more than one tube 17 can be employed. Similarly a prototype had two tubes containing glycerol, each tube extending sideways out of the filter so that the movement of fluid 19 could be observed. On puffing, with glycerol in the tubes the following data was observed:

| Puff No | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Dilution % | 0 | 0 | 0 | 0 | 0 | 0 | 0 | 3 | 3 | 12 | 11 | 8 | 10 | 17 | 27 | 30 |

Other arrangements are of course possible. One of these is shown in FIG. 3 where the viscous fluid 19 is disposed in lengthwise extending channels 21 formed in the filter 12. The tipping paper 13 closes off the channel 21 so that a tube is effectively created. Again the perforations 14 communicate only with the channels. Any number of channels could be provided.

FIG. 4 shows an arrangement similar to that shown in FIGS. 1 and 2 but the tube 17 also contains particles and/or fibres around which is the viscous fluid. The particles/fibres act as packing in the flow tube 17 and will require a tube 17 of wider bore. The particles/fibres act as a series of small channels through which the viscous fluid is drawn when the arrangement is puffed. Once the fluid is expressed from the tube 17 air will be able to flow between the particles/fibres.

FIGS. 5A, 5B and 5C show a simple tube 17 which is surrounded by a porous absorbent filter material 25. FIG. 5A shows the arrangement before puffing. It will of course be appreciated that the tube 17 in FIG. 5A would in use be assembled within the filter in a similar manner to the tube 17 in FIGS. 1 and 2. The surface tension of the viscous fluid 19 retains the fluid 19 in the tube 17 whatever its orientation.

After a number of puffs, as depicted in FIG. 5B, the fluid is drawn out of the mouth end of the tube somewhat. There is, however, the tendency for the fluid to flow back into the tube between puffs due to surface tension effects. However the presence of the absorbent material 25 overcomes these effects and the viscous fluid 19 is wicked away from the tube 17 each time the smoking article is puffed. After a time the tube becomes unblocked.

It will of course be appreciated that the tube 17 does not necessarily empty itself of the viscous fluid. It is also clear that the use of absorbent material could also be applied to channel type arrangement exemplarised by FIG. 3.

Another example of a technique to help the removal of the viscous fluid 19 from the tube 17 is shown in FIGS. 6A, B and C. A second tube 26 is arranged outside the tube 17 in a concentric manner. Only the inner tube 17 communicates with ventilation perforations in the filter.

Again, as the device is puffed the viscous fluid is drawn out of the mouth end of the tube. The surface tension effects ensure that the fluid 19 is drawn into the annular space between tubes 17, 26 so as to progressively unblock tube 17 on further puffs.

Highly viscous liquids can be used in conjunction with relatively wide bores. For example, some viscous materials are displaced upon puffing, but do not fully recover (due to surface tension) between puffs. Subsequent puffs increase the displacement of the viscous material until finally there is breakthrough leaving the material coating the inside of the tube.

Figure 7:
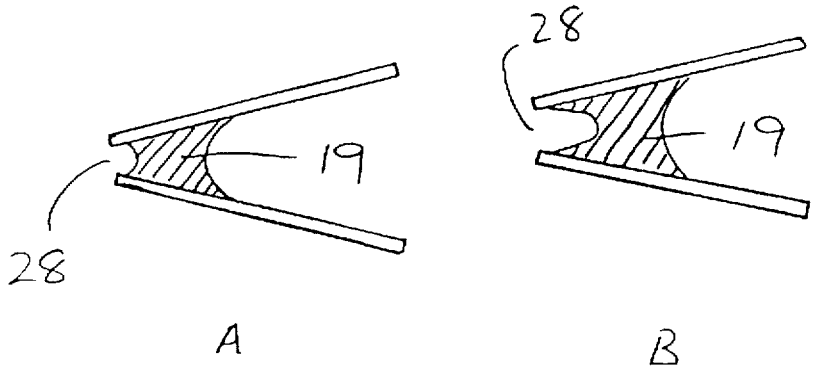
Figure 7:
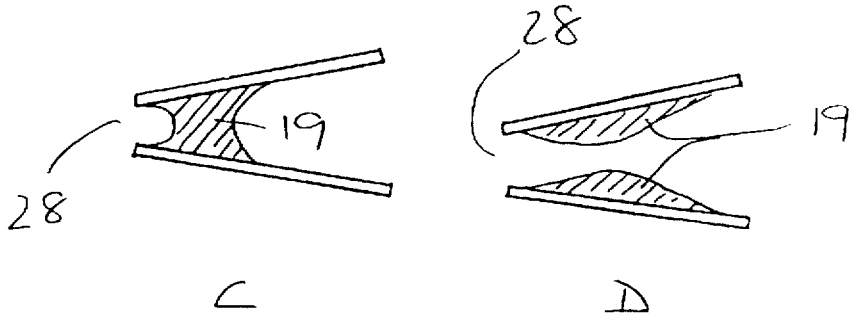

It has been found that an open ended conical tube is particularly suitable in such an arrangement as shown in FIG. 7. The narrow end 28 communicates with the ventilation holes 14. The viscous material 19 is disposed in the tube and surface tension urges the material towards the small bore of the cone. It will be appreciated that the cone angle and bore sizes will determine the maximum amount of material that can be retained by surface tension such that gravity is overcome in all orientations of the tube 19.

FIGS. 7A, B, C and D illustrate the operation of the conical tube outlined above. FIG. 7A shows the arrangement before puffing, FIG. 7B shows the displacement of the viscous material 19 during the first puff and FIG. 7C shows the slight recovery of the viscous material 19 in the dwell between puffs. FIG. 7D shows the arrangement at the breakthrough puff and it will be seen that the viscous material 19 has not left the tube but forms a coating along a length of the tube wall.

The displacement effect and the final breakthrough are accentuated using a conical tube, but other effects can be obtained as desired using tubes of other shapes and sections. In one envisaged arrangement a capillary funnel is provided. The funnel comprising a capillary tube communicating with the ventilation means at one end and a conical tube similar to that in FIG. 7 at the other end.

Another example uses 'plastic' materials which change shape under load without returning to their original shape after the load is removed. Such a property has advantages in that there is no tendency for the material to be drawn back into the tube in the dwell between puffs. Vaseline is an example of such a material having such properties.

In FIGS. 8 and 9 there is shown a tubular insert 40 having an external diameter similar to that of the smoking article in which it is to be incorporated. An aperture 41 is provided in one side of the insert 40. A tube 42 is cut partway along its length and cut sideways to allow the two leg portions 43 to be bent back through 90° so as to produce a T-shaped element 44. This element is secured inside the insert 40 with the uncut end of the tube communicating with the aperture 41. The outwardly facing edges of the leg portions 43 abut the inside of the insert 40 opposite the aperture 41. A predetermined quantity of viscous fluid 19 is introduced into the uncut portion of the tube 42. The insert can then be incorporated in a cigarette. The aperture 41 will only be opened after the viscous fluid is drawn out of the tube 42 by the action of puffing, the viscous fluid being drawn initially into collection areas defined between the legs 43 and the insert 40.

In FIG. 10 there is shown a perspective view of a two piece injection moulding and the components in assembled form. The moulding replicates the description given in FIGS. 8 and 9 where the dimensions of the fluid filled tube and its crucial positional relationship to the receiving system to remove the fluid are the same. Further the moulding, enumerated as FIGS. 1 and 2, include a circumferential groove 15 where in this case it is inappropriate to include the whole circumference. FIG. 10 shows the assembled moulding and its relationship with conventional cigarette construction materials. The perforations 14 in the paper 13 communicating with the circumferential groove in the moulding complete the ventilation means. Conventional ventilation is also depicted as a single row of perforations. The minimum ventilation being provided by the conventional means and the maximum ventilation provided by both the conventional means and the so described ventilation means.

The ventilation means, fluid and filter may be biodegradable to allow the consumer to dispose of the butts without environmental problems.

Although the invention has been described mainly with respect to cigarettes, it could be applied to any other smoking article including cigars, pipes etc.

I claim:

1. A smoking article comprising a smokable rod and a ventilation means located within said smokable article and communicating with the outside of said article, viscous fluid in said ventilation means closing or partially closing said ventilation means, said viscous fluid being displaceable during use of said smoking article enabling ventilation to occur.

2. A smoking article as claimed in claim 1 wherein the viscous fluid has a viscosity of between 0.01 Poise (0.01 Stokes) and 1000 Poise (1000 Stokes).

3. A smoking article as claimed in claim 1 wherein the viscous material is plastic deformable under load without returning to its original shape after the load is removed.

4. A smoking article as claimed in claim 1 wherein the ventilation means is biodegradable.

5. A smoking article comprising a smoking rod, a filter and ventilation means incorporated in said filter and communicating with the outside of said smoking article, viscous fluid in said ventilation means closing or partially closing said ventilation means, said viscous fluid being displaceable during use of said smoking article enabling ventilation to occur.

6. A smoking article as claimed in claims 1 and 5 wherein the ventilation means includes vents in the periphery of the smoking article.

7. A smoking article as claimed in claim 6 wherein the ventilation means is comprised of one or more tubes or one or more channels located in the periphery of the ventilation means.

8. A smoking article as claimed in claim 7 wherein the ventilation means is comprised of one or more tubes.

9. A smoking article as claimed in claim 8 wherein the viscous fluid is disposed in one or more of said tubes.

10. A smoking article as claimed in claim 9 wherein the tubes vary in cross-section along their length.

11. A smoking article as claimed in claim 8 wherein said one or more tubes are open-ended and have a larger internal cross-sectional area towards the lower pressure end of the user's end of the said smoking article.

12. A smoking article as claimed in claim 11 wherein the tube or tubes are conical.

13. A smoking article as claimed in claim 7 wherein the ventilation means is comprised of one or more channels located in the periphery of the ventilation means.

14. A smoking article as claimed in claim 13 wherein the viscous fluid is disposed in one or more of said channels.

15. A smoking article as claimed in claim 7 wherein removal means are provided around the fluid exit end of the channels or tubes to assist the removal of viscous fluid.

16. A smoking article as claimed in claim 15 wherein the removal means comprises an absorbent material to wick away the fluid.

17. A smoking article as claimed in claim 15 wherein the removal means comprises slits, channels or tubes.

18. A smoking article as claimed in claim 15 wherein the removable means comprises an outer concentric channel or tube.

19. A smoking article as claimed in claim 7 wherein the channels or tubes contain particles and/or fibers.

20. A filter for a smoking article comprising a filter and ventilation means incorporated in said filter and communicating with the outside of said filter, said ventilation means containing a viscous fluid closing or partially closing said ventilation means, said viscous fluid being displaceable during use of said filter with a smokable rod.

21. A filter as claimed in claim 20 wherein the ventilation means is comprised of one or more tubes.

22. A filter as claimed in claim 20 wherein the ventilation means is comprised of one or more channels located in the periphery of the ventilation means.

23. A filter as claimed in claim 22 wherein the tube or tubes are open-ended and have a larger internal cross-sectional area towards one end of the filter.

24. A filter as claimed in claim 21 or claim 22 wherein the channels and tubes also contain particles and/or fibers.

25. A filter as claimed in claim 20 wherein the ventilation means incorporates vents in the periphery of the filter.

26. A filter as claimed in claim 25 wherein said vents communicate only with one or more tubes in which said viscous fluid is disposed.

27. A filter as claimed in claim 26 wherein said one or more tubes have ends of wider board to prevent capillary loss of the viscous fluid.

28. A filter as claimed in claim 25 wherein the vents communicate with one or more channels located in the periphery of the filter and have viscous fluid disposed therein.

29. A filter as claimed in claim 26 or claim 28 wherein removal means are provided around the fluid exit end of the channels or tubes to assist the removal of viscous fluid.

30. A filter as claimed in claim 29 wherein the removal means comprise slits, channels or tubes.

31. A filter as claimed in claim 29 wherein the removal means comprises an outer concentric channel or tube.

32. A filter as claimed in claim 31 wherein the tube or tubes are conical.

33. A filter as claimed in claim 20 wherein the viscous fluid has a viscosity between 0.01 Poise (0.01 Stokes) and 1000 Poise (1000 Stokes).

34. A filter as claimed in claim 20 wherein the viscous fluid is plastic deformable under load without returning to its original shape after the load is removed.

35. A filter as claimed in claim 20 wherein the ventilation means is biodegradable.

* * * * *